US006332500B1

(12) United States Patent
Ellefsen et al.

(10) Patent No.: US 6,332,500 B1
(45) **Date of Patent: *Dec. 25, 2001**

(54) ANCHOR SYSTEM FOR THE TRANSFER OF FLUIDS

(75) Inventors: Olav Vaage Ellefsen, Forus; Kåre Syvertsen, Arendal, both of (NO)

(73) Assignee: Den Norske Stats Oljeselskap A. S., Stavanger (NO)

( * ) Notice: Subject to any disclaimer, the term of this patent is extended or adjusted under 35 U.S.C. 154(b) by 0 days.

This patent is subject to a terminal disclaimer.

(21) Appl. No.: 09/125,361

(22) PCT Filed: Aug. 7, 1996

(86) PCT No.: PCT/NO96/00201

§ 371 Date: Dec. 9, 1998

§ 102(e) Date: Dec. 9, 1998

(87) PCT Pub. No.: WO97/30887

PCT Pub. Date: Aug. 28, 1997

(30) Foreign Application Priority Data

Feb. 21, 1996 (NO) ..... 960698

(51) Int. Cl.[7] ..... E21B 33/038; B63B 21/00

(52) U.S. Cl. ..... 166/352; 166/345; 405/224; 114/230.2; 114/230.26; 441/5

(58) Field of Search ..... 166/345, 352, 166/366, 367; 405/169, 170, 171, 224, 224.1, 224.4; 114/230.1, 230.11, 230.3, 231, 296, 293, 294; 441/3, 4, 5

(56) References Cited

U.S. PATENT DOCUMENTS

| | | | | |
|---|---|---|---|---|
| Re. 33,434 | * | 11/1990 | Pomonik et al. | 114/230.26 |
| 3,411,473 | * | 11/1968 | Mott et al. | 114/296 |
| 3,430,597 | | 3/1969 | Zunderdorp | 114/230.24 |
| 3,455,270 | | 7/1969 | Mascenik et al. | 114/230.15 |
| 3,608,652 | * | 9/1971 | Medders | 166/358 X |
| 3,670,686 | | 6/1972 | Reynolds | 114/230.13 |
| 3,774,253 | * | 11/1973 | Lecomte | 114/230.14 X |
| 3,840,927 | * | 10/1974 | Reid, Jr. | 114/230 X |
| 4,065,822 | * | 1/1978 | Wilbourn | 114/230.22 X |
| 4,130,076 | * | 12/1978 | Van Bilderbeek | 441/5 |
| 4,509,448 | * | 4/1985 | Pease et al. | 114/230.12 X |
| 4,602,586 | * | 7/1986 | Ortloff | 114/230.15 |
| 4,727,819 | * | 3/1988 | Pollack | 114/230.12 |
| 4,793,737 | * | 12/1988 | Shotbolt | 405/169 |
| 4,828,430 | * | 5/1989 | Van Der Heyden | 405/224 X |
| 5,505,560 | * | 4/1996 | Brown et al. | 405/169 X |
| 5,704,307 | * | 1/1998 | Treu et al. | 114/230.13 |
| 5,772,483 | * | 6/1998 | Vielmo et al. | 114/230.27 X |
| 5,816,183 | * | 10/1998 | Braud et al. | 114/230.13 |
| 5,875,395 | * | 2/1999 | Poranski, Sr. | 114/230.15 |
| 6,109,197 | * | 8/2000 | Breivik et al. | 114/230.2 |

FOREIGN PATENT DOCUMENTS

| | | | | |
|---|---|---|---|---|
| 2056391 | * | 3/1981 | (GB) | 114/230 |
| 2183581 | | 6/1987 | (GB) . | |
| 177779 | | 8/1995 | (NO) . | |
| 9324731 | | 12/1993 | (WO) . | |

* cited by examiner

*Primary Examiner*—David Bagnell
*Assistant Examiner*—Jong-Suk Lee
(74) *Attorney, Agent, or Firm*—Foley & Lardner

(57) ABSTRACT

An anchoring system for the production of hydrocarbons at sea by employing a moored production vessel or ship in which the ship is equipped with a mooring apparatus, preferably at the bow portion, and with at least one connection unit for a production riser from the seabed. Included is an anchor located at the seabed, as well as at least one anchor line adapted to connect the anchor to the mooring apparatus on the ship. There being provided a permanent anchor, preferably in the form of a suction anchor, gravitation anchor, or pile anchor. The anchor being provided with a swivel mechanism for the anchoring line, preferably with a buoyant body attached at a middle portion of the anchoring line, and whereby the riser is in the form of at least one flexible hose, the lower end of which is connected to said swivel mechanism. The flexible hose contains at least two passages for hydrocarbons and possibly other fluids.

18 Claims, 9 Drawing Sheets

ANCHOR SYSTEM FOR THE TRANSFER OF FLUIDS

BACKGROUND OF THE INVENTION

1. Field of the Invention

This invention relates to a system for the production of hydrocarbons at sea, by employing a moored production vessel or ship, whereby the ship concerned is equipped with mooring means preferably at its bow part, and at least one connection unit for a production riser from the seabed, and where there is involved anchor means disposed at the seabed, as well as at least one anchoring line adapted to connect the anchor means to the mooring means on the ship.

2. Description of the Related Art

In offshore oil and gas activity there is often the question of very important operations that can be difficult under certain conditions, and whereby there is usually involved transfer of fluids. Fluids in the form of hydrocarbons are of particular interest in this connection, since the invention is directed to a production system for oil or gas wells at the seabed. In such a system the anchoring function is a very important part of the total arrangement. Under varying and difficult conditions, whereby wind, waves and ocean currents have influence, great stresses and forces can occur during such mooring and carrying out of these operations. Such stresses in the first place can lead to wrecking and for example uncontrolled oil discharge.

In two international patent applications filed simultaneously, focus is placed on a pure mooring system, i.e. international application no. PCT/NO96/00203 (our ref. INT6165L), and a loading-unloading system respectively, i.e. international patent application no. PCT/NO96/00202 (our ref. INT6252L). Thus the present invention has several points of contact with the contents of these two simultaneous patent applications. When comparing with the latter of the two applications, it is to be remarked in particular that in production the seabed there will normally occur much higher pressures in the fluids concerned, than what will be found during usual loading or unloading of hydrocarbons for example.

SUMMARY OF THE INVENTION

This invention provides novel and specific features being more closely stated in the claims.

Among the advantages obtained by means of the invention, it is emphasized in particular that the challenging operations mentioned, can be carried out under difficult conditions with high security and reliability in most situations, compared to previously known methods and systems. In this connection it is to be noted in particular that the system according to the invention makes possible a type of elasticity or flexibility in the mooring and the fluid transfer, that involves adaption of the whole system according to the stresses and forces occuring during the operations to be performed. For production of hydrocarbons at sea it is furthermore very important that the invention makes it possible to obtain an efficient production without the common very high investments, at the same time as security is attended to. A substantial point is also that the system permits of free rotation of the ship with anchoring system and risers around a center in the anchor being held at the seabed.

BRIEF DESCRIPTION OF THE DRAWINGS

In the following description the invention will be explained more closely with reference to the drawings, in which.

DETAILED DESCRIPTION OF THE DRAWINGS

Figure 1:
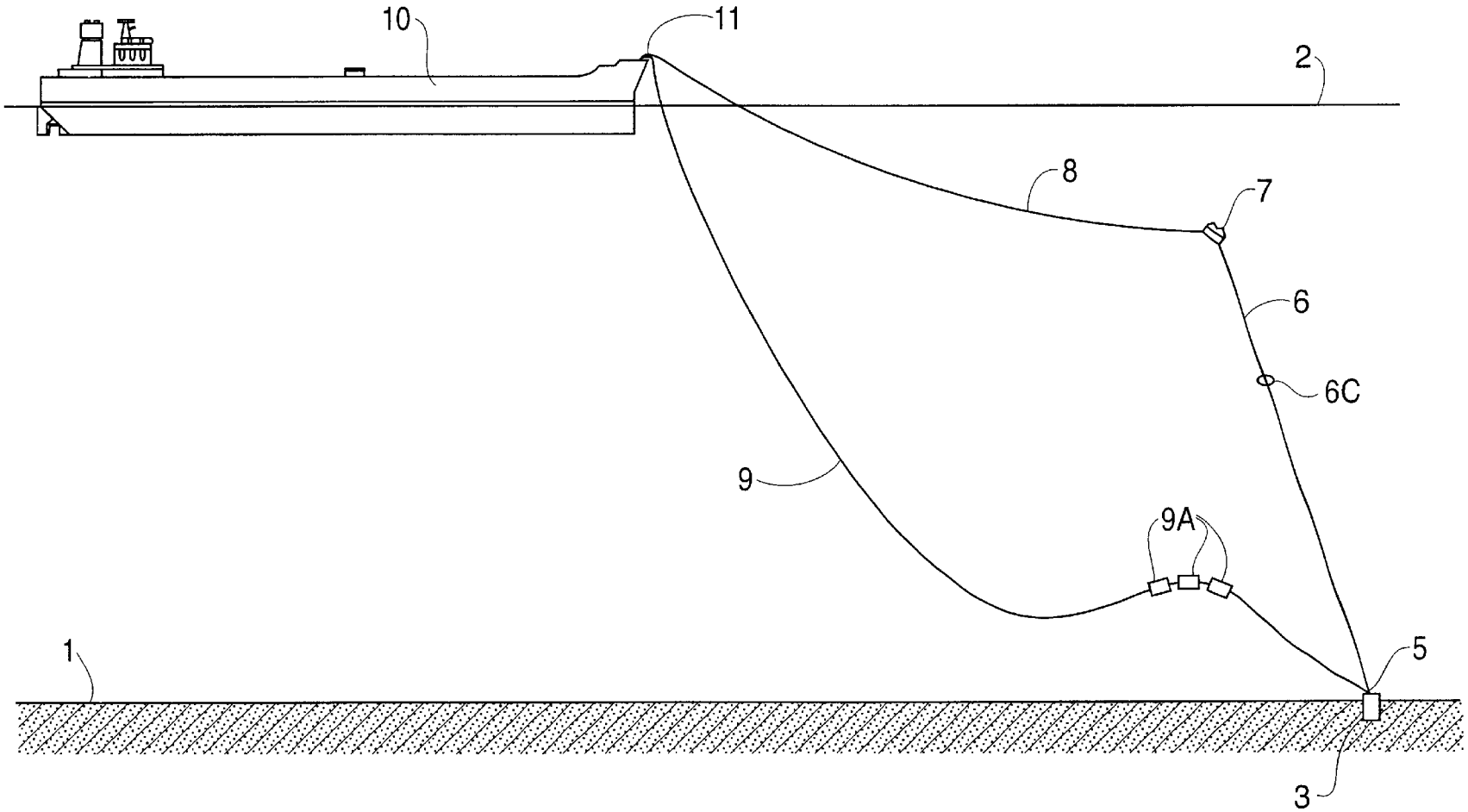
FIG. 1 schematically shows a first embodiment of the system according to the invention, FIG. 2 more in detail and elevation shows an anchor with associated swivel means, which can be included in a system according to the invention.

In FIG. 1 of the drawings the seabed is indicated at 1 and the sea surface at 2, as well as substantially the whole system according to the invention with the total arrangement involved in a mooring situation with associated operations. There is here in the first place the question of a production vessel or ship 10, which can be a converted tanker, an anchor 3 at the seabed 1 and an anchoring line with two parts 6 and 8 being at a middle portion provided with a buoyant body 7, also denoted line buoy. In the usual manner the ship 10 is equipped with mooring means 11 at the bow, without any details being shown more closely at this point.

The system according to the invention as described so far, is sufficient for the desired mooring of the ship 10, and in this connection involves advantages as already mentioned in the introduction above. An important feature of the mooring system is the line buoy 7, which is preferably located at or connected to a middle portion of the total anchoring line 6, 8. It is obvious that buoy 7 does not need to be attached exactly at the middle of the total line length, but in order that the desired effect be obtained, it is and advantage that the buoy is positioned at a good distance both from the lower end of anchoring line 6 at anchor means 3, and from the upper end of anchoring line 8 at mooring means 11.

The dimensions of buoy 7 are chosen so that under most conditions or stresses a quite significant angle difference between the adjacent portions of line parts 6 and 8 is established. Thus line part 6 will normally extend upwards from anchor 3 at a clearly smaller angle in relation to the vertical, than the angle at which line part 8 runs out from buoy 7. When the ship 10 is strongly affected by wind, waves or ocean currents, the whole anchoring line 6, 8 may be tightened more than shown e.g. in FIG. 1, so that buoy 7 is pulled deeper into the water and the angle between line parts 6 and 8 can approach more or less 180°. As an opposite extreme when a minimum of mooring forces are acting, buoy 7 may float to the sea surface 2, if the length of line part 6 is larger than the water depth.

When operations and installations in more rough waters are concerned, e.g. far out at sea, buoy 7 as a rule will be located well immerged under the sea surface. This is per se a very favourable situation for the buoy and the whole system, since the buoy when located deep in the water is less subjected to influence from wind and waves occuring at the sea surface. It is also an important effect of buoy 7 that under substantially all conditions this will maintain anchoring line part 6 tensioned upwards from anchor 3, so that no part of the anchoring line will be lying on the seabed 1.

Figure 7:
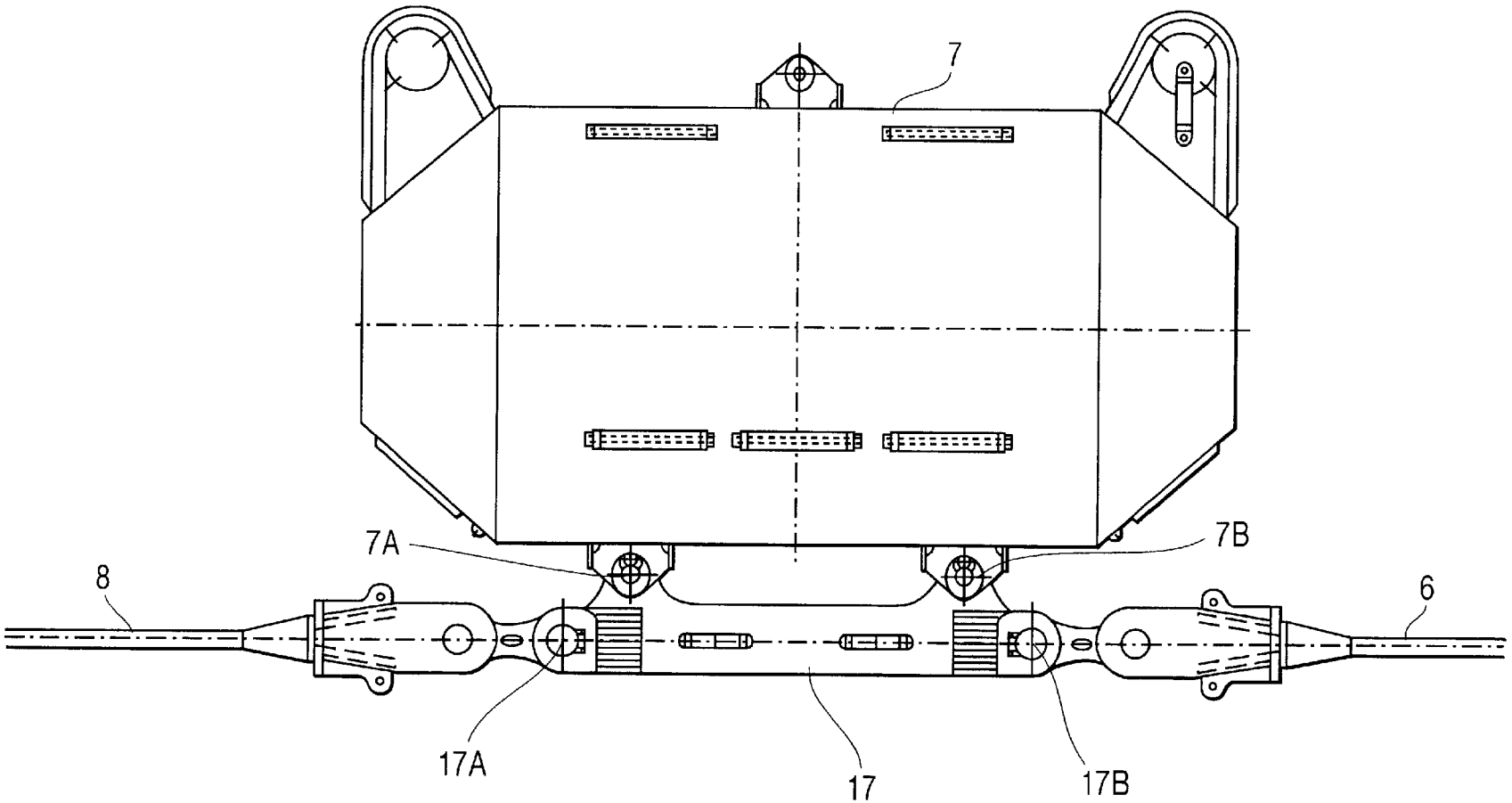
FIG. 7 shows in detail a preferred sign of the attachment of a bouy to the anchoring line, FIG. 8 in elevation shows an anchor being somewhat modified in relation to that in FIGS. 2–4.

There may also be cases where this buoy device comprises more than one individual buoy, but still so arranged that there is provided a relatively limited deflection portion more or less at the middle of the total anchoring line. The main purpose of such a buoy or buoy device is to provide for a relatively concentrated buoyancy in the anchoring line, which results in a soft or flexible behaviour of the whole mooring system, with reduced dynamic load effects. FIG. 7 shows a structure associated with buoy 7, being advantageous in practice.

In addition to the pure mooring function being explained above, the total system also comprises fluid transfer between the anchor means 3 and the ship 10, for the purpose of producing hydrocarbons. Thus in FIG. 1 there is shown a relatively flexible hose 9 as a riser being extended up to the bow portion of the ship 10, which is there provided with suitable connection means, that may very well be combined with the mooring means 11. Such means can be of designs being known per se. At a lower portion of hose 9 there are shown buoyant elements 9A, which in this case are provided in a number of three, but can of course vary in number and dimensions depending on the desired shape of hose 9. A primary purpose of buoyant elements 9A is to secure that the lower portion of hose 9 is generally always elevated from seabed 1. It is a great advantage that hose 9 runs through the water well underneath anchoring line 6, 8, as illustrated in FIG. 1. Thereby any contact between the two main parts of the system is avoided, in particular so that hose 9 will not be damaged by any part of anchoring line 6, 8. When there is here the question of a hose 9 it is obvious that this can be in a twin form or in the form of more or less parallel two or three separate hoses. See in this connection FIG. 6.

Figure 2:
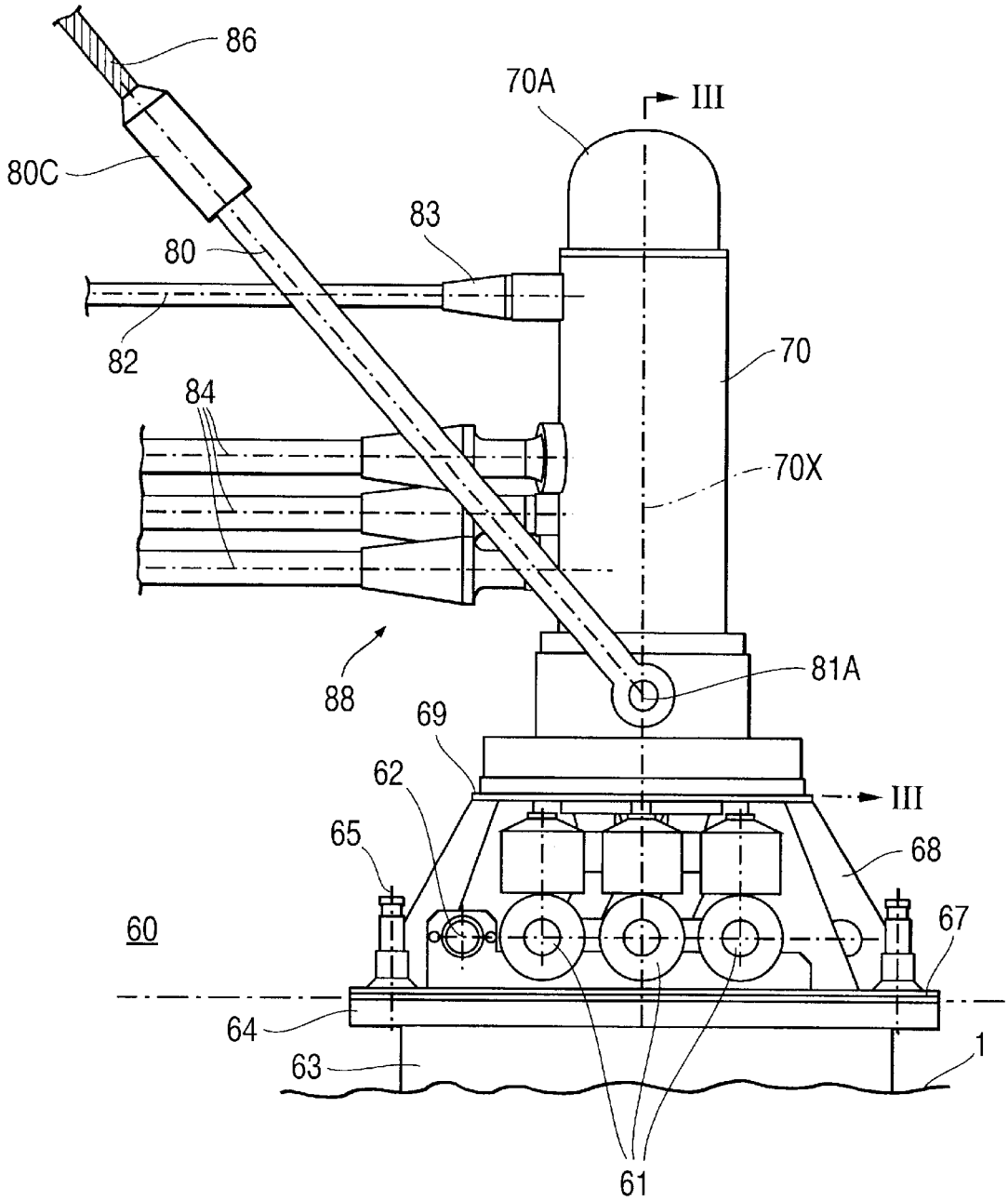
Figure 3:
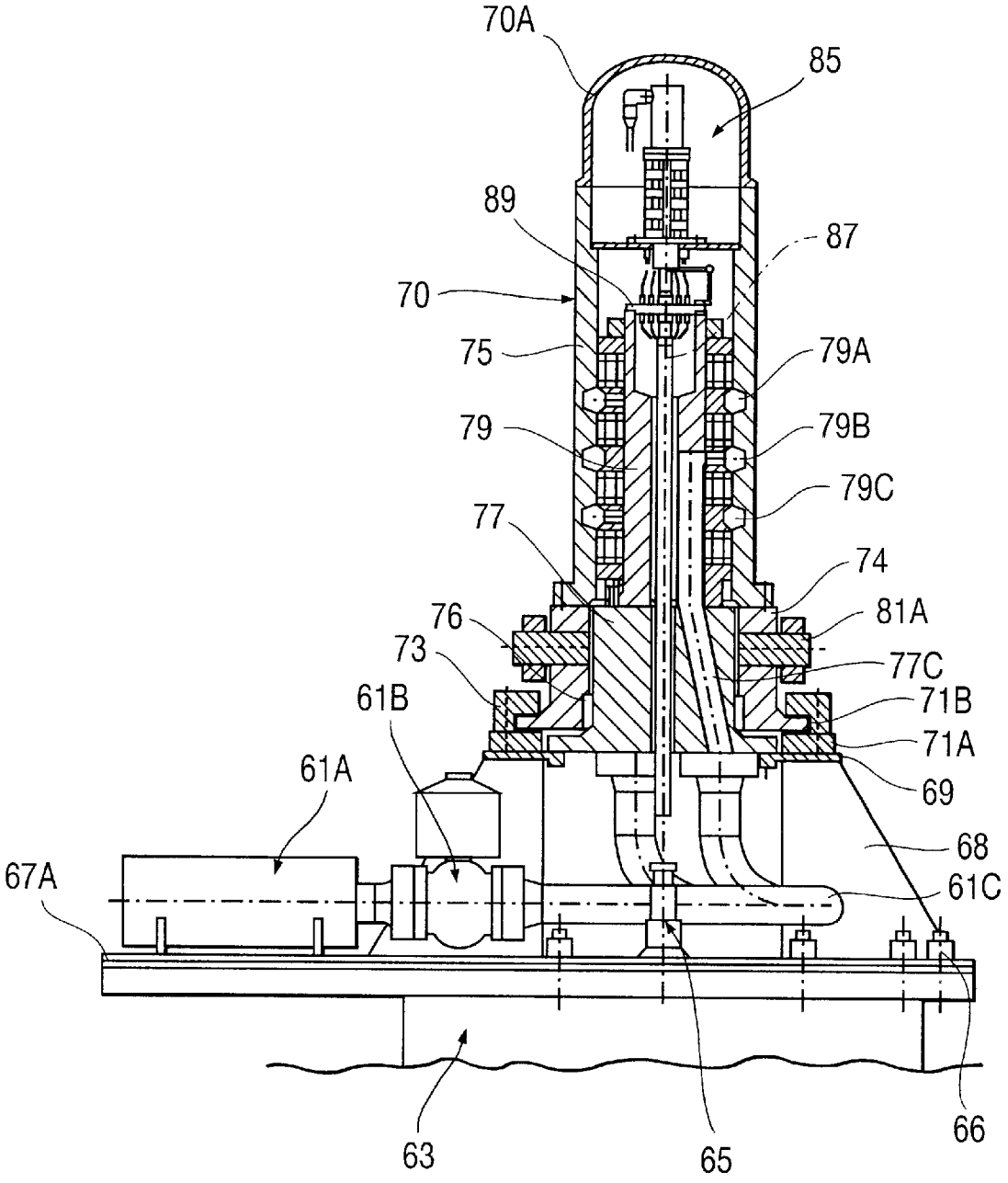
FIG. 3 shows the same as FIG. 2 in lateral view and partial axial section along the line III in FIG. 2.
Figure 4:
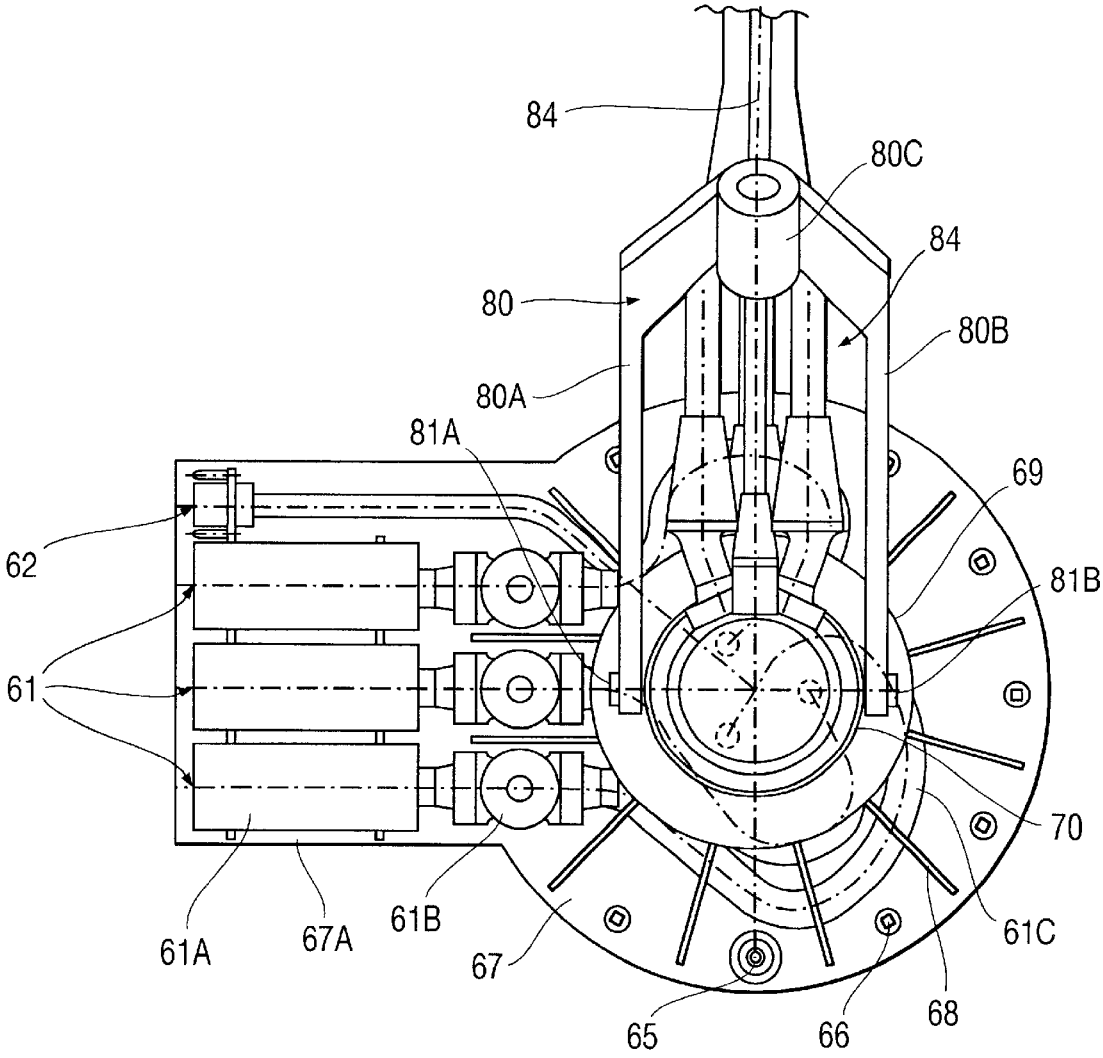
FIG. 4 shows the anchor of FIGS. 2 and 3 as seen from above.

FIGS. 2, 3 and 4 in more detail show a design of an anchor with associated equipment. This anchor structure in the first place comprises the actual anchor part 63 being preferably in the form of a suction anchor and adapted to penetrate a distance into the seabed indicated at 1 in FIG. 2. It is also possible to employ an anchor part based upon gravitation or piling at the seabed 1. On its upper side suction anchor 63 is provided with a top plate or frame 64 on which the remaining equipment units in the total anchor structure are mounted. The main component in this equipment can be considered to be swivel means 70 which is rotatable on a socket-like supporting member 68. This in turn has a plate- or frame-like base member 67 resting on top of suction anchor 63, i.e. on plate 64. As will be seen in particular from FIGS. 3 and 4 the plates or frames 64 and 67 are joined by bolt connections, one such bolt with its associated nut or the like being shown at 66 in FIGS. 3 and 4. With such a design the total anchor structure can be divided in two parts, namely along a line or a plane as indicated at 60 in FIG. 2, upon loosening of bolt connections 66. Accordingly the more vital parts of the anchor structure can be retrieved to the surface for maintenance, repair or replacement and so forth. It is also possible to contemplate the alternative of retrieving only parts of the unit for repair, for example only the actual rotating connector, whereas the anchoring part with the swivel journal are left at the seabed. In principle the method will be similar to what is described, but with a lighter load to be lifted. On plate 64 there are provided guide posts 65 for the purpose of this disassembly and in particular lowering and landing of the part having been retrieved, on the actual anchor part 63, 64, after maintenance or the like. This is more closely illustrated in FIG. 10.

Before separation and retrieval as discussed above, there must be provided for disconnection of pipelines and cables being extended from an installation for subsea production, to the anchor structure for connection thereto. For this purpose there are shown connectors 61 for pipelines and a specific connector 62 for a control cable or umbilical. According to FIGS. 3 and 4 these connectors can be located on a cantilevered part 67A of the base member 67.

In FIG. 2 the lower end of an anchoring line is shown at 86, and via suitable connection elements and fastening means are connected to the lower parts of the swivel means housing 70. More particularly there is provided a yoke 80 having two parallel legs, as will appear from FIG. 4, whereby the legs are interconnected at their upper ends by lateral elements to a fastening member 80C for line end 86. At the lower ends of legs 80A and 80B there are provided fastening means in the form of a pivot connections 81A or 81B which makes it possible for yoke SO together with anchoring line 86 to assume varying angular positions in the vertical plane, depending upon the anchoring situation with respect to the vessel or ship concerned.

Yoke 80 with fastening elements or pivots 81A and 81B also serve to provide for a sufficiant torque for the swivel movement of the swivel means about its central vertical axis 70X (FIG. 2), depending upon the direction of the mooring force from the vessel concerned, through anchoring line 86.

The swivel comprises at least one connection part 88 for a number of risers or hoses 84, preferably corresponding to the number of connectors 61. Moreover there is shown a connection part 83 higher up on a swivel housing 70, for a control cable 82 or the like, corresponding to connector 62. Thus the anchor structure with swivel means can provide for the required connections between a production installation at the seabed and a production vessel or ship at the surface, whereby the vessel with mooring as explained, will be able to swing around the anchor depending upon weather, wind and waves, and possibly also sea currents.

The hose or risers 84 are entered through the connection part or parts at one side of and preferably at a central region with respect to the total height of swivel housing 70. As will be seen in particular from FIG. 4 the hose(s) will extend from swivel housing 70 between the yoke legs 80A and 80B, and at a more horisontal angular position than the yoke legs, as will be seen from FIG. 2. The direction of the hose(s) out from the swivel structure is suitably quite close to horisontal, as will appear from FIG. 2. The same applies to control cable 82. This arrangement involves a minimum of risk that the hose or risers, or possibly the control cable can be damaged by contacting any portion of yoke 80 or the anchoring line 86 itself.

In connection with the above it is to be noted that cable 82 and riser 84 but not the least the anchoring line 86 with yoke 80 can exert very significant lateral forces on the anchor structure, so that parts of this structure can be subjected to great bending stresses. In view of this it is very advantageous that the point of attack of the mooring forces, i.e. fastening elements 81A and 81B, are positioned as low as possible in the structure. This means that these fastening elements 81A and 81B for yoke 80 normally are adapted to be located lower than connection parts 83 and 88 in the anchor structure as installed.

The required inner elements in the swivel means are shown relatively schematically in FIG. 3, where sealing elements and fluid passages as shown at 79A, 79B and 79C can be designed for example similar to the swivel described in Norwegian patent No. 177.779. It will be recognized that said three swivel passages or paths 79A–C correspond to the connectors 61 and risers 84 respectively. More specifically in FIG. 3 there is shown a pipe connection 61C from one connector 61A through a fluid passage 77C in a stationary inner part 77 and further up through a still stationary core member 79 of the actual swivel, to fluid passage 79B, which has the shape of an annulus, as for example in the above mentioned Norwegian patent specification.

It is very important that said inner elements with core 79 and the sealings around the annalus passages 79A–c are not subjected to large mechanical stresses as a result of bending moments in the anchor structure and the swivel means, because of the forces discussed above, being due to the anchoring of the hose and cable connections respectively. The stucture shown in FIG. 3 takes care of this problem by having swivel housing 75 joined at a lower portion, for example by means of bolts, to a boss 74 which in turn through journal means transfer the forces to supporting member 68 which via base member 67 is anchored to the actual anchor part 63. The journal, which is also necessary for the above mentioned swivel movement about axis 70X (FIG. 2) comprises a lower flange on boss 74 held between a lower journal ring 71A and a holding ring 71B attached thereto. In the journal there are included bearing elements as shown at 73 and 76, so that boss 74 and thereby the whole swivel structure above it, can rotate in relation to the stationary journal parts and the supporting structure underneath these. This structure comprises an upper plate 69 on supporting member 68, which otherwise can mainly consist of a number of bracing plates distributed around the circumference as will be seen from FIG. 4.

With the structural solutions just described above, the central and stationary core of the swivel thus together with the interior elements mentioned, will be supported in a somewhat resilient manner in relation to the supporting parts of the structure, including the actual anchor part or suction anchor 63. For this purpose pipe connections as shown for example at 61C in FIGS. 3 and 4, are suitably bent and made with such flexibility that the resiliancy will be obtained without any parts of the structure being in an undesireable way subjected to bending moments or other forces exceeding reasonable limits.

At this point there is reason to note that interior elements in the form of electrical connections and the like as indicated at 85 on top of swivel housing 70, and provided with an enclosure 70A, are not to a corresponding degree as the remaining interior elements vulnerable to the stresses mentioned. Electrical components and equipment as shown at 85 at one side is connected outwards through control cable 82 and at the other side centrally down through core 79 as a bundle uf wires or the like 87, for further connection out to connector 62 in FIGS. 2 and 4. It will be seen that the electrical components 85 also comprise a slip-ring device at indicated at 89 in FIG. 3.

A somewhat modified version of the anchor structure in FIGS. 2, 3 and 4 is discussed briefly below with reference to FIGS. 8 and 9.

Figure 5:
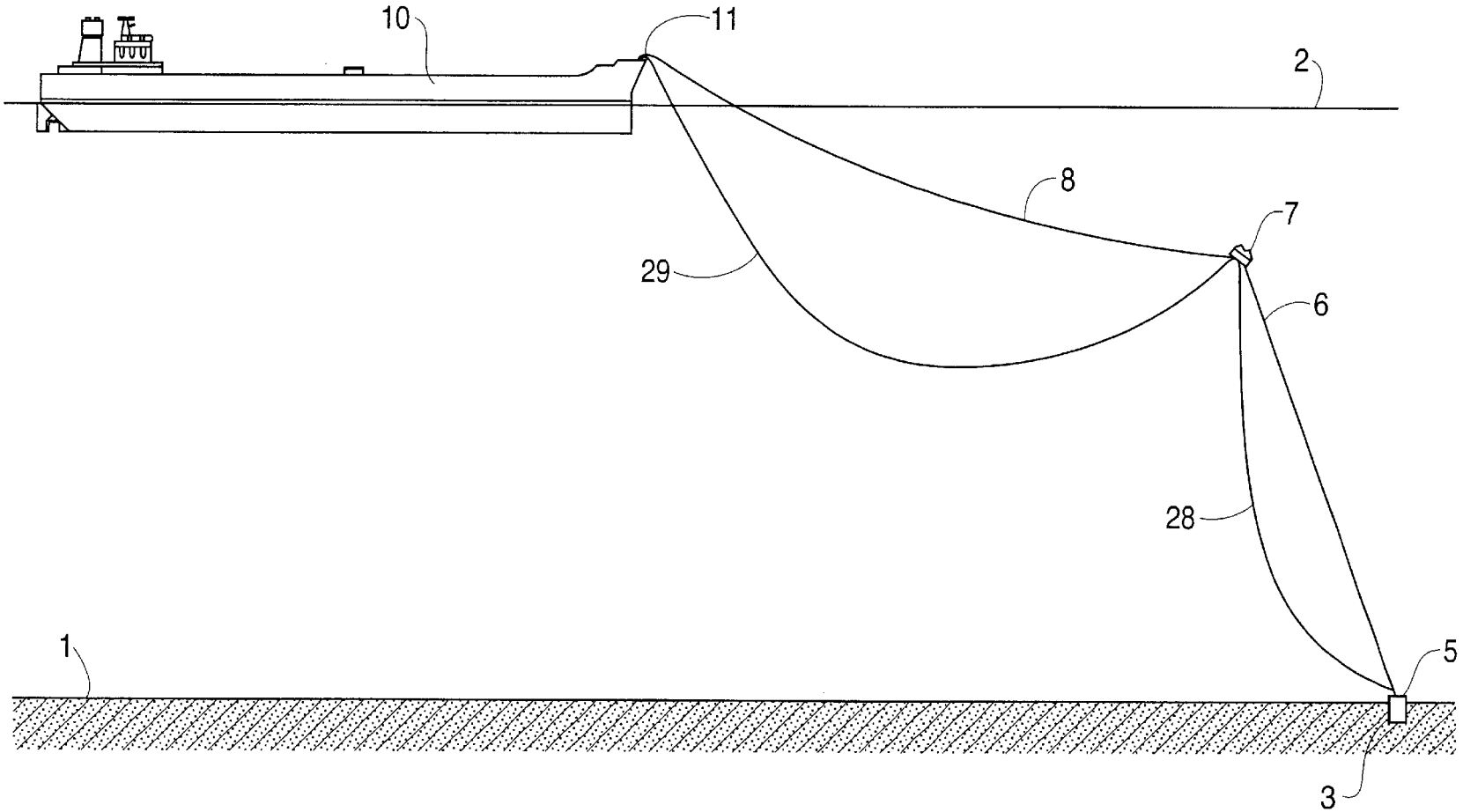
FIG. 5 shows a variant of the embodiment of FIG. 1.

FIG. 5 shows a modification of the arrangement in FIG. 1, where the transfer hose 28, 19 in FIG. 5 has not been provided with its own buoyant element, but is suspended from line buoy 7. As a result of hose parts 28 and 29 being of larger length then corresponding parts of anchoring lines 6 and 8, respectively, the hose will generally run through the water at a good distance underneath the anchoring line. In this embodiment buoy 7 apparently must be dimensioned to have somewhat more buoyancy than in the embodiment of FIG. 1. Compared to FIG. 1 the system of FIG. 5 should be considered to act as a more integral, unitary system, which may be better maintained under control when the ship 10 moves around the anchoring point during varying weather conditions. This can be advantageous e.g. in view of varying currents at smaller or larger water depth.

When suspending hose 28, 29 in buoy 7 as mentioned above, it can be an advantage to provide a supporting bend or the like for guiding the suspension portion of the hose with a certain radius of curvature that is not too small, so that the hose at this portion will not have undue bending or tensional stresses. A further possibility at this point is that suspension from the buoy can take place through a more or less resilient element, so that hose 28, 29 is only subjected to relatively soft or damped movements in relation to buoy 7.

Figure 6:
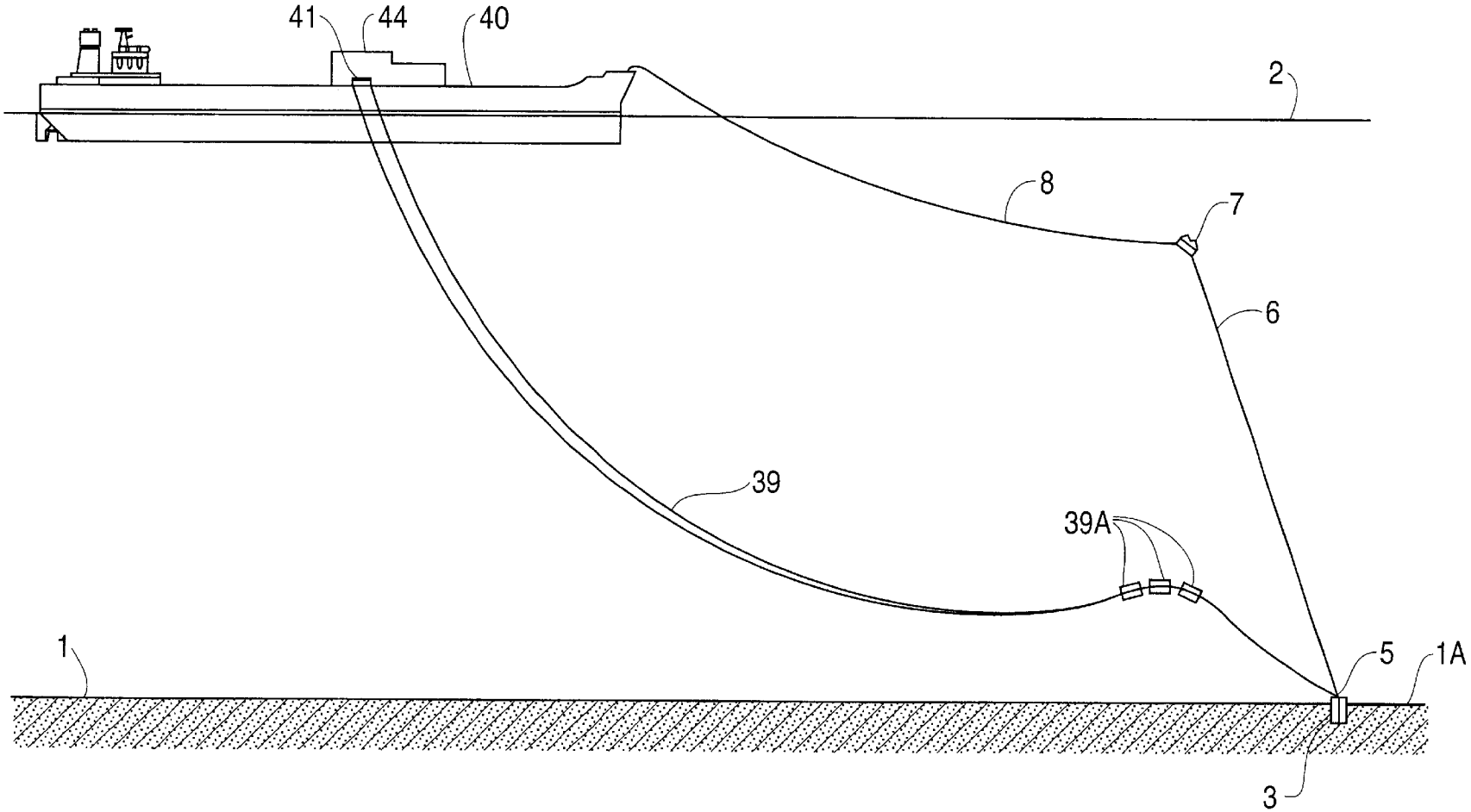
FIG. 6 shows another variant of the system, whereby the vessel to be served, is equipped with a process module for the hydrocarbons produced.

To a substantial degree the arrangement of FIG. 6 is based on a system according to the invention being in the principle like the embodiment of FIG. 1, but in FIG. 6 the riser hoses 39 with associated buoyancy elements 39A at the lower portion, are connected at 41 mid-ship of ship 40 with their upper ends. Here there may be the question of connecting means 41 being conventional per se, for example of the manifold type. More specifically the ship 40 is equipped in order to be able to serve as a production vessel, and for this purpose has been furnished with equipment in the form of a processing module 44. Connecting means 41 can be considered to belong to this module. Besides FIG. 6 shows a mooring system with a suction anchor 3 at the seabed 1, as in the embodiments of FIGS. 1 and 5. Moreover in FIG. 6 there is shown schematically how pipelines 1A can be laid to the anchor 3 from a (not shown) production installation at the seabed.

Relatively detailed in FIG. 7 there is shown an advantageous design in connection with buoy 7, which is connected to the two parts 6 and 8 of the anchoring line, as described previously. FIG. 7 in particular shows a rigid, rod-shaped element 17 inserted between line parts 6 and 8 and attached to buoy 7 by means of for example bolt connections 7A and 7B. The ends of line parts 6 and 8 can be attached at 17A and 17B to connecting element 17 by more or less conventional means. Thus this element can relieve the actual buoy structure from the relatively great forces being carried through anchoring line 6,8. In view of safety and lifetime factors for the whole system, this is a very advantageous solution in actual practice.

Figure 9:
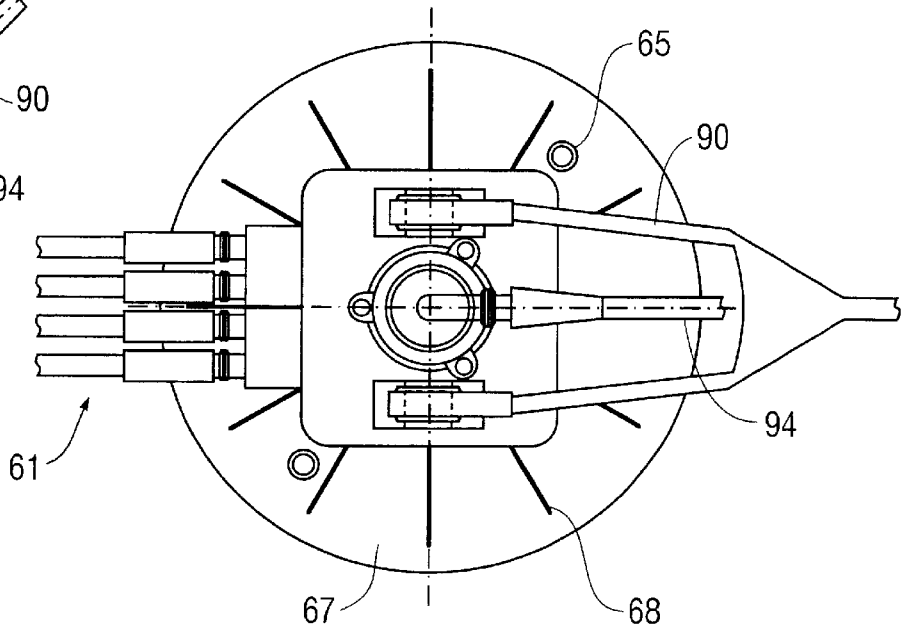
FIG. 9 shows the anchor of FIG. 8 seen from above, and FIG. 10 serves to illustrate an operation for seperating the main parts of the anchor in FIG. 8, from each other.
Figure 8:
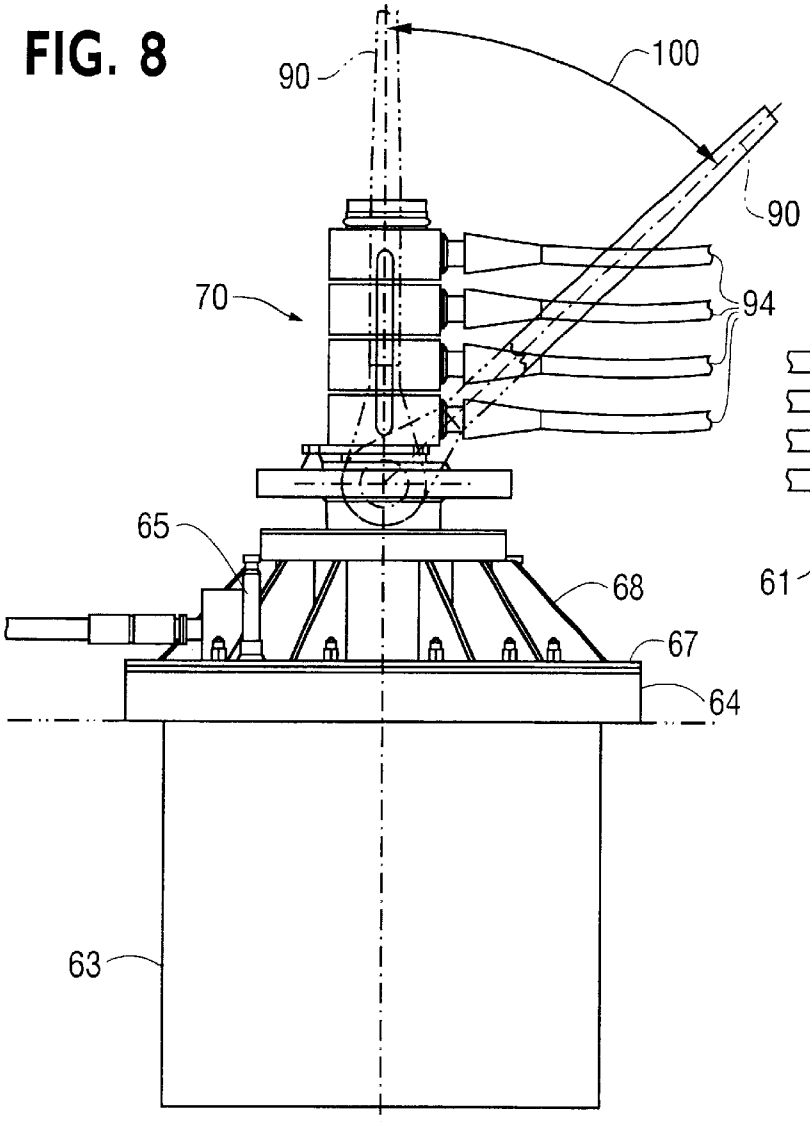

As indicated with some of the same reference numerals, the design of the anchor in FIGS. 8 and 9 has many main features in common with the anchor structure of FIGS. 2, 3 and 4. In certain respects however, the structure of FIGS. 8 and 9 is to be preferred, and the following modifications are to be noted:

The yoke 90 as shown in FIG. 9 has two legs which are not parallel to the same degree as in FIG. 4, but converge somewhat in a direction towards the common lateral member and attachment element for the anchoring line (not shown).

FIG. 8 also illustrates a favourable angular range indicated at 100 within which the yoke can move freely, depending, inter alia, of the water depth at the site where mooring takes place. In the dot-dash drawn vertical position 90' of the yoke, the mooring force thus will act vertically so that the bending moments referred to above, do not act on the anchor. Besides this vertical position 90' of the yoke has much interest also for installation or retrieval operations as mentioned above, and to be further explained below.

Another difference from the previously described enbodiment, consists in the arrangement of risers or hoses, possibly also cables 94 mutually aligned, in contrast to the group of riser hoses 84 as seen FIGS. 2 and 4. The arrangement of FIGS. 8 and 9 apparently allow the hoses 94 to be extended laterally more held together and centrally in relation to yoke 90, as will be seen in particular from FIG. 9.

Figure 10:
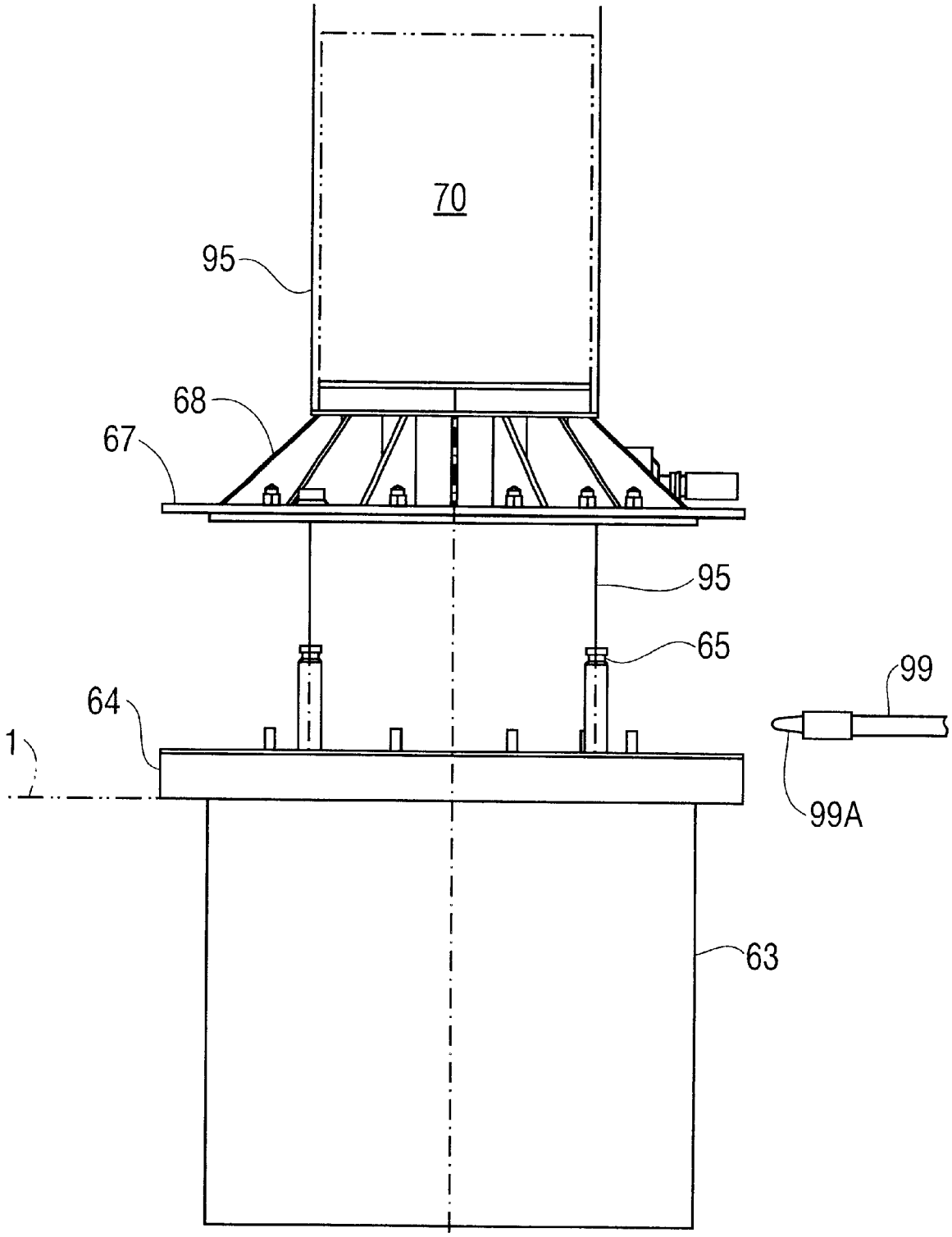

Specifically in association with FIG. 8 there is shown in FIG. 10 a situation where the upper and vital parts of the anchor structure are separated from the actual anchor part 63, whereby guidelines 95 are connected to guide posts 65 in order to guide the swivel and its supporting members 67, 68 in a usual manner during retrieval or re-installation. The actual swivel device 70 is indicated only schematically in FIG. 10. Finally FIG. 10 shows a disconnected pipeline end 99 having an associated connector part 99A.

The system described here with its various modifications, can e.g. be intended for operation at water depths from 150–300 meters. At a depth of e.g. 200 meters the two parts 6 and 8 of the total anchoring line can typically be 160 meters and 200 meters respectively, in a favourable practical embodiment.

Otherwise it is obvious that various modifications and variants can be contemplated within the framework of the invention. Thus when it is stated that anchor 3 is permanent, this does not mean e.g. that a suction anchor or a gravitation anchor must remain forever at the seabed 1, upon being installed. As known even such relatively fixed installations at the seabed can be removed by suitable means and equipment. A permanent anchor device in this context means that the actual anchor part 63 (FIGS. 2,3 and 8) is more permanently installed than what is the case with a common achor as typically carried by a ship and can be thrown or hauled into the ship, by means of its normal anchor capstan.

A method of installation of an anchor device in the system as explained above, according to the invention with advantage can consist in that the anchor is suspended at the end of an anchor chain or wire belonging to a generally regular anchor capstan or winch of the ship concerned, being employed for lowering the anchor to a predetermined point at the seabed. See in this connection the yoke position 90' in FIG. 8.

What is claimed is:

1. A system for the transfer of fluids at sea comprising:

a moored production vessel or ship, said ship or production vessel including a mooring apparatus and a connection unit for a production riser;

an anchoring device located at the seabed, said anchoring device including a permanent anchor part affixed to the seabed, a swiveling mechanism and at least two passages suitable for transporting fluids;

at least one anchoring line attached to said swiveling mechanism for rotating said swiveling mechanism and connecting said anchoring device to said mooring apparatus, said anchoring line comprising at least one buoyant body disposed during anchoring to be normally immersed in the sea, wherein the anchoring line is connected to said swiveling mechanism with a yoke comprising two parallel legs and a cross bar, the outer ends of said legs being pivotably attached on different sides of said swiveling mechanism; and the production riser connected to said swiveling mechanism, said production riser comprising at least one flexible hose; and journals for said swiveling mechanism which are adapted to transfer bending forces from said connected production riser and said anchoring line to the permanent anchor part without stressing internal elements of said swiveling mechanism.

2. A system according to claim 1, wherein said permanent anchor part is selected from the group consisting of suction anchor, gravitation anchor and pile anchor.

3. A system according to claim 1, wherein said production riser comprises at least one passage suitable for transporting a non-hydrocarbon fluid and one passage for transporting a hydrocarbon fluid.

4. A system according to claim 1, further comprising a rigid connecting element inserted in said anchoring line, wherein said buoyant body is attached to said rigid connecting element.

5. A system according to claim 1, further comprising at least one buoyant body attached to said production riser.

6. A system according to claim 1, wherein said production riser and anchoring line are attached to the same buoyant body.

7. A system according to claim 1, wherein the production riser is connected centrally at said swiveling mechanism and extends from said swiveling mechanism centrally between the yoke legs.

8. A system according to claim 1, wherein said anchoring line having an upper portion extending from said ship or production vessel to said buoyant body and a lower portion extending from said buoyant body to said swivel mechanism and said production riser laying in a more horizontal angular position than the angular position of said lower portion of said anchoring line.

9. A system according to claim 1, wherein said production riser is adapted to lay underneath said anchoring line.

10. An anchor for use in the production of hydrocarbons at sea comprising:

a permanent anchor part affixed to the seabed;

a swiveling mechanism adapted to rotate about a rotation axis approximately vertical to the seabed, said swiveling mechanism including attachment members for at least one anchoring line for providing torque to said swiveling mechanism, and at least one connection member for a fluid hose and at least two fluid passages adapted to be connected to an installation at the seabed; and journals for said swiveling mechanism which are adapted to transfer bending forces from said connected fluid hose and said anchoring lines to the permanent anchor part without stressing internal elements of said swiveling mechanism.

11. An anchor according to claim 10, wherein said permanent anchor part is selected from the group consisting of a suction anchor, gravitation anchor and pile anchor.

12. An anchor according to claim 10, wherein said attachment members are adapted to be located below said connection member.

13. An anchor according to claim 10, further comprising, a base member and joining elements wherein said base member is detachably join ed to said permanent anchor part with said joining elements.

14. An anchor according to claim 13, further comprising a supporting member for said swiveling mechanism, and first connectors for pipelines and second connectors for cables from an installation for production at the seabed.

15. An anchor according to claim 14, wherein said connectors are adapted for connection and disconnection of said pipelines and cables.

16. An anchor according to claim 15, further comprising a stationary central core in said swiveling mechanism resiliently attached to said permanent anchor part.

17. An anchor according to claim 16, further comprising a connection for a control cable located in an upper portion of said swiveling mechanism and an enclosure for wire connections.

18. An anchor according to claim 17 further comprising an electrical slip-ring device.

* * * * *